US009835996B2

(12) United States Patent
Nagai

(10) Patent No.: US 9,835,996 B2
(45) Date of Patent: Dec. 5, 2017

(54) SLIDING MEMBER INCLUDING SILOXANE HAVING A REACTIVE SUBSTITUENT AND HOLDING MEMBER HAVING GROUP WHICH CAN REACT WITH THE SUBSTITUENT, FIXING DEVICE INCLUDING SLIDING MEMBER, IMAGE FORMATION APPARATUS, AND METHOD FOR PRODUCING SLIDING MEMBER

(71) Applicant: KONICA MINOLTA, INC., Chiyoda-ku, Tokyo (JP)

(72) Inventor: Yasuki Nagai, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/336,292

(22) Filed: Oct. 27, 2016

(65) Prior Publication Data

US 2017/0139360 A1 May 18, 2017

(30) Foreign Application Priority Data

Nov. 18, 2015 (JP) ..... 2015-225894

(51) Int. Cl.
*G03G 15/20* (2006.01)

(52) U.S. Cl.
CPC ..... *G03G 15/2075* (2013.01); *G03G 15/2089* (2013.01); *G03G 2215/2009* (2013.01)

(58) Field of Classification Search
CPC ..... G03G 15/2025; G03G 15/2075; G03G 15/2089; G03G 2215/2016
USPC ..... 399/329
See application file for complete search history.

(56) References Cited

U.S. PATENT DOCUMENTS

| | | | | |
|---|---|---|---|---|
| 5,621,512 | A | 4/1997 | Uehara et al. | |
| 5,999,788 | A | 12/1999 | Kanesawa et al. | |
| 7,142,803 | B2 * | 11/2006 | Koyama et al. | G03G 15/206 399/329 |
| 7,333,762 | B2 | 2/2008 | Oishi et al. | |
| 7,720,423 | B2 * | 5/2010 | Omata | G03G 15/2064 399/329 |

FOREIGN PATENT DOCUMENTS

| | | | |
|---|---|---|---|
| JP | 08262903 | A | 10/1996 |
| JP | 10020699 | A | 1/1998 |
| JP | 10213984 | A | 8/1998 |
| JP | 11024457 | A | 1/1999 |
| JP | 11133776 | A | 5/1999 |
| JP | 2000112271 | A | 4/2000 |
| JP | 2001249558 | A | 9/2001 |
| JP | 2004206105 | A | 7/2004 |
| JP | 2005275371 | A | 10/2005 |
| JP | 2007240550 | A | 9/2007 |
| JP | 2009069400 | A | 4/2009 |
| JP | 2011059302 | A | 3/2011 |

OTHER PUBLICATIONS

Japanese Office Action dated Oct. 3, 2017 issued in counterpart Japanese Application No. 2015-225894.

* cited by examiner

*Primary Examiner* — William J Royer
(74) *Attorney, Agent, or Firm* — Holtz, Holtz & Volek PC

(57) ABSTRACT

A sliding member includes siloxane having a reactive substituent, and a holding member having a group which can react with the substituent and bonds to the substituent to hold the siloxane.

14 Claims, 4 Drawing Sheets

SLIDING MEMBER INCLUDING SILOXANE HAVING A REACTIVE SUBSTITUENT AND HOLDING MEMBER HAVING GROUP WHICH CAN REACT WITH THE SUBSTITUENT, FIXING DEVICE INCLUDING SLIDING MEMBER, IMAGE FORMATION APPARATUS, AND METHOD FOR PRODUCING SLIDING MEMBER

This application is based on Japanese Patent Application No. 2015-225894 filed with the Japan Patent Office on Nov. 18, 2015, the entire content of which is hereby incorporated by reference.

BACKGROUND OF THE INVENTION

Field of the Invention

The present invention relates to a sliding member, a sliding member for a fixing device, a fixing device, an image formation apparatus, and a method for producing a sliding member.

Description of the Related Art

Japanese Laid-Open Patent Publication No. 08-262903 discloses a fixing device with which an image formation apparatus of an electrophotography system, such as a printer, a copier, and a facsimile is equipped. This fixing device has a pressurizing and fixing roll, an endless belt in contact with this pressurizing and fixing roll, and a pressing member which is disposed inside this endless belt and presses an inner circumferential surface of the endless belt toward the pressurizing and fixing roll. This type of fixing device allows the roll and the belt to be pressed into contact with each other to form a fixing nip, and accordingly, it is referred to as a belt nip fixing system and is considered to be advantageous in that it is excellently energy-saving, light-weight, compact and inexpensive.

Japanese Laid-Open Patent Publication No. 2004-206105 discloses a fixing device of a configuration in which a sheet-like sliding member sliding on an inner circumferential surface of a pressurizing belt is provided to a pressing member and a lubricant is interposed between this sheet-like sliding member and the inner circumferential surface of the pressurizing belt. This fixing device can have between the inner circumferential surface of the pressurizing belt and the pressing member a sliding resistance reduced by the lubricant and thus allows the pressurizing belt to be smoothly, circularly moved together with a fixing roll. As the lubricant, silicone oil, amino modified silicone oil, methylphenyl silicone oil, etc. are used. Furthermore, as the sheet-like sliding member, a glass cloth or the like impregnated with fluororesin and sintered is used. A fluororesin containing, sheet-like sliding member is also disclosed in Japanese Laid-Open Patent Publication Nos. 10-213984 and 2001-249558.

Japanese Laid-Open Patent Publication No. 2009-069400 describes as a lubricant holding member equivalent to the above sheet-like sliding member an example using a mesh sheet of aramid fiber.

However, silicone oil degrades through thermal oxidation. For example, when the fixing device is continuously operated for a long period of time, the pressurizing belt's rotation torque when the belt circularly rotates increases. The increase of the rotation torque occurs because the sliding resistance of the pressurizing belt and the sheet-like sliding member increases as the silicone oil's viscosity increases. Furthermore, a phenomenon is observed in which the silicone oil leaks from the pressurizing belt's widthwise opposite ends (or the belt's ends in the direction of the rotation axis) and the silicone oil adheres to a surface of the pressurizing belt. This phenomenon is also considered to be attributed to the silicone oil's degradation based on continuous operation over long time. It is believed that silicone oil is thermal oxidized and degraded because as temperature increases to be high, a radical is generated and subsequently, the silicone oil crosslinks between molecules and thus gelates.

Accordingly, when using silicone oil as a lubricant for a fixing device, the silicone oil is degraded by long-term use, which causes inconvenience, such as an increased torque when circularly rotating the pressurizing belt, leakage of the lubricant toward an outer circumferential surface of the pressurizing belt, and the like. Furthermore, when the lubricant leaks, the lubricant between the sliding member and the inner circumferential surface of the pressurizing belt becomes insufficient, and the sliding member and the pressurizing belt are increasingly abraded, which leads to a failure of the fixing device.

SUMMARY OF INVENTION

The present invention has been made in view of the above circumstances, and contemplates a sliding member, a sliding member for a fixing device, a fixing device, an image formation apparatus, and a method for producing a sliding member, that can prevent reduction in durability performance attributed to a lubricant's degradation and thus serve for long-term use.

In order to achieve the above object, a sliding member of the present invention comprises: siloxane having a reactive substituent; and a holding member having a group which can react with the substituent and bonds to the substituent to hold the siloxane.

A sliding member for a fixing device of the present embodiment is the above sliding member used for the fixing device, and the fixing device comprises a roller and an endless belt rotating together in contact with each other, and a pressing member disposed at an inner circumferential side of the endless belt, and pressing an inner circumferential surface of the endless belt toward the roller and thus cooperating with the roller to sandwich the endless belt. The sliding member is disposed between the endless belt and the pressing member or as a portion of the pressing member.

A fixing device of the present invention comprises: a roller and an endless belt rotating together in contact with each other; a pressing member disposed at an inner circumferential side of the endless belt, and pressing an inner circumferential surface of the endless belt toward the roller and thus cooperating with the roller to sandwich the endless belt; and the above sliding member that is disposed between the endless belt and the pressing member or as a portion of the pressing member, the endless belt's inner circumferential surface including a base material having at least one of a free amino group and a free carbonyl group.

An image formation apparatus of the present invention includes the above fixing device.

A method for producing a sliding member according to the present invention is a method for producing a sliding member comprising a holding member, comprising: impregnating the holding member with siloxane having a reactive substituent; and heating and firing the holding member that is impregnated with the siloxane to cause the holding member to hold the siloxane.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
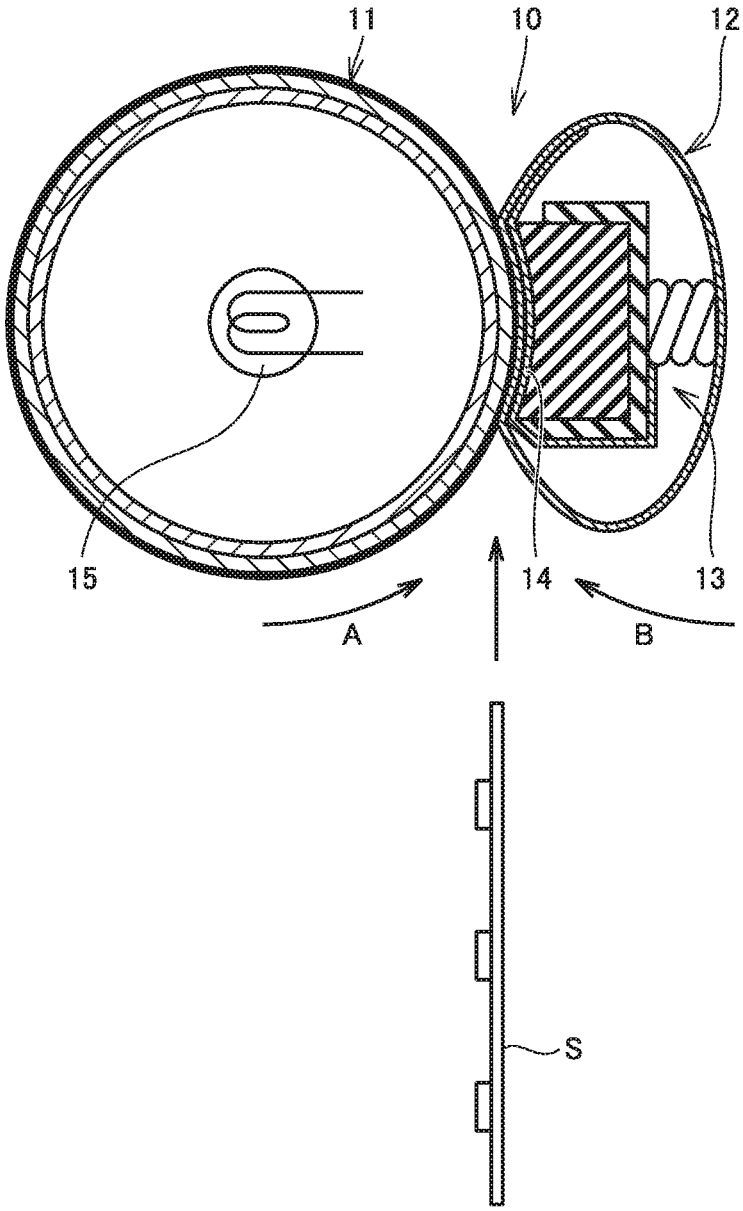
FIG. 1 is a schematic diagram showing a schematic configuration of a fixing device of the present embodiment.

Hereinafter, an embodiment according to the present invention will be described more specifically. Note that when describing the following embodiment using the drawings, identical reference characters indicate identical or corresponding components.

<Sliding Member>

A sliding member according to the present embodiment includes siloxane which has a reactive substituent (hereinafter also referred to as a "reactive siloxane"), and a holding member which has a group which can react with the above substituent and bonds to the above substituent to hold the reactive siloxane. The sliding member in the present embodiment is in the form of a sheet for example. As long as a desired effect is obtained, the sliding member's shape is not limited to a sheet, and it may be a rectangular parallelepiped, a cylinder having a horizontally circular or elliptical cross section, or other stereoscopic shapes. Note that, in the present embodiment, the shape of the holding member itself serves as the shape of the sliding member.

<Holding Member>

The holding member can be of any appropriate material that has a group which can react with the above substituent and bond to the above substituent to hold the reactive siloxane. Specifically, preferably, the holding member includes a heat-resistant fiber which has either one or both of a free amino group and a free carbonyl group. More preferably this heat-resistant fiber is aramid fiber. The holding member may be a resin containing the above heat-resistant fiber. Preferably, the holding member has heat resistance to endure a high temperature up to about 250° C.

Furthermore, it is preferable to use a heat-resistant nonwoven fabric as the holding member as the heat-resistant nonwoven fabric allows excellent impregnation of siloxane. Inter alia, it is more preferable to use a nonwoven fabric composed of aramid fiber (hereinafter also referred to as an "aramid fiber nonwoven fabric sheet") as it has high versatility. Note that a nonwoven fabric which is composed of polyimide fiber which has heat resistance which endures high temperature up to about 250° C. can be used as the holding member. The holding members may be a heat-resistant fiber other than aramid fiber.

<Siloxane Having Reactive Substituent>

The reactive substituent that the siloxane has may be a substituent with which either one or both of a free amino group and a free carbonyl group that the holding member has can react. Specifically, one or more types selected from a free amino group, a free epoxy group, and a free carbonyl group can be used. Inter alia, siloxane which has a free amino group is suitable as it is commercially available in various grades and easily available. Note that the amino group in the present embodiment is assumed to include any monovalent functional group that is ammonia, primary amine, or secondary amine, said ammonia, primary or secondary amine having hydrogen removed therefrom. Furthermore, the free carbonyl group indicates a group represented by "═C═O" included in methacrylic acid, a carboxyl group, etc.

The reactive substituent (any one of the free amino group, the free epoxy group and the free carbonyl group) is disposed in siloxane at an intramolecular position which can be indicated in three forms from chemical constitution formulae (1) to (3) shown below. In the chemical constitution formulae (1) to (3) shown below, "A" indicates the reactive substituent. More specifically, there are a form in which the reactive substituent is disposed at opposite terminals of siloxane, as shown in the chemical constitution formula (1), a form in which the reactive substituent is disposed at one terminal of siloxane, as shown in the chemical constitution formula (2), and a form in which the reactive substituent is disposed at one of side chains of siloxane, as shown in the chemical constitution formula (3).

Note that, in the chemical constitution formulae (1)-(3) shown below, R indicates an alkyl group which may have a substituent. This alkyl group is preferably a methyl group or an ethyl group. Furthermore, when a plurality of As are present in one molecule, one of the free amino group, the free epoxy group, and the free carbonyl group may be selected and the same substituent may be disposed at each portion of A or a different substituent may be disposed there.

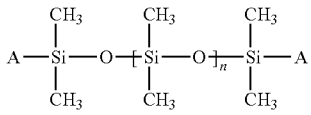

(1)

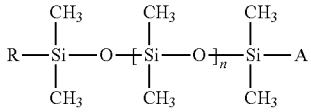

(2)

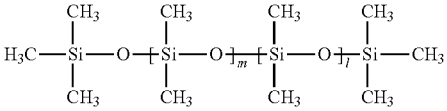

(3)

In the chemical constitution formulae (1)-(3) above, l, m, and n each indicate a degree of polymerization. The degree of polymerization is as follows: l=1-500, m=0-300, m+l=10-500, and n=10-500. When the degree of polymerization is lower than the range of the values indicated by l, m, and n, siloxane will volatilize in a process for heating and firing a later-described holding member impregnated with siloxane, and not only is the siloxane unable to be held in the holding member in a desired amount, but there is also a possibility that the volatilized siloxane may cause contamination, which is unpreferable. When the degree of polymerization is higher than the range of the values indicated by l, m, and n, the principal chain's degradation by thermal oxidation easily occurs, and accordingly, there is a possibility of leakage and scattering accompanying decomposition, and furthermore, as the siloxane's decomposed molecules react with each other, gelation is facilitated, and there is a possibility that torque may increase, which is unpreferable.

Furthermore, the reactive substituent is disposed in siloxane at an intramolecular position which can indicate another form. That other one form is a form in which the reactive substituent is disposed at opposite side chains of the siloxane, although not described by a chemical constitution formula.

In the present embodiment, it is advantageous in terms of slidability and durability that the reactive substituent is disposed at the opposite terminals of the siloxane. Siloxane is considered to allow higher slidability when it has a larger number of methyl groups in one molecule. This is because when disposing the reactive substituent at a terminal is compared with doing so at a side chain, the former allows a larger number of methyl groups in one molecule and hence high slidability. Furthermore, more substituents in one molecule allow larger strength after the fixation to the holding member, and accordingly, disposing the reactive substituent at the opposite terminals will allow more excellent durability than doing so at one terminal.

Note that the chemical structure of the siloxane that has the reactive substituent can be identified by using any one of gas chromatography (GC), high performance liquid chromatography (HPLC) and an NMR device, for example.

In view of resistance to thermal oxidation, easiness of adding the siloxane to the holding member, and slidability, the siloxane suitably has a viscosity of 10-1000 $mm^2/s$ (i.e., equal to or greater than 10 $mm^2/s$ and equal to or less than 1000 $mm^2/s$; note that in the present specification when a numerical range is indicated with "- (to)," the range is assumed to include its upper and lower limits' numerical values). In particular, 10-100 $mm^2/s$ is preferable. Siloxane having a viscosity of 10-100 $mm^2/s$ has a low molecular weight and is accordingly, characteristically less decomposable and less degradable. Furthermore, the equivalent of the functional group of the siloxane is suitably 100-10000 g/mol in view of strength, durability and slidability obtained after it reacts and is fixed to the holding member. The equivalent of the functional group of the siloxane is more preferably 500-5000 g/mol.

The siloxane's viscosity can be measured as follows: More specifically, it can be measured with a Ubbelohde viscometer by ASTM D445-46T or JIS Z 8803. Furthermore, the equivalent of the functional group of the siloxane can be calculated as follows: More specifically, the siloxane's weight average molecular weight is calculated by HPLC and the number of reactive substituents is obtained from the chemical structure of the siloxane identified as described above, and the number of these reactive substituents divided by the above weight average molecular weight serves as the equivalent of the functional group of the siloxane.

Note that, in the present specification. "slidability" refers to a nature relating to less friction or slidability relative to the member affected, and for example, in a fixing device described later, "slidability" serves as an index of how easily an endless belt with which a sliding member is in contact rotates. "Slidability" can be assessed in level for example by measuring an external motor's torque, as will be described hereinafter. In other words, "high slidability" indicates that a low torque is measured and "low slidability" indicates that a high torque is measured.

<Method for Producing the Sliding Member>

A method for producing a sliding member according to the present embodiment is a method for producing a sliding member comprising a holding member, comprising: impregnating a holding member with siloxane which has a reactive substituent, and heating and firing the holding member that is impregnated with the siloxane to cause the holding member to hold the siloxane. The holding member has a group which can react with the above substituent and bonds to the above substituent to hold the siloxane.

For example, in an example using an aramid fiber nonwoven fabric sheet as the holding member, initially, siloxane which has the reactive substituent is immersed in or applied to the aramid fiber nonwoven fabric sheet to impregnate the sheet with the siloxane. Subsequently, the siloxane-impregnated, aramid fiber nonwoven fabric sheet is heated and thus fired for about 1-2 hours in a temperature range of 180-220° C. using an oven capable of controlling moisture by dry air etc. Thereby, the free amino group or free carbonyl group of a surface of the aramid fiber nonwoven fabric sheet and the reactive substituent that the siloxane has react with each other and thus chemically bond together. As a result, the aramid fiber nonwoven fabric sheet has a surface modified into siloxane (hereinafter also referred to as "siloxane-modified," "siloxane modification" etc.), and the siloxane will be held on the aramid fiber nonwoven fabric sheet.

In the above method for producing the sliding member it is preferable to impregnate the aramid fiber nonwoven fabric sheet with the reactive siloxane at a ratio of 1.0-2.5 parts by weight of the reactive siloxane relative to 1 part by weight of the aramid fiber nonwoven fabric sheet. Impregnating with the reactive siloxane in an excessive amount can promote sufficient siloxane modification. Furthermore, this is also preferable because siloxane modification can also be caused on the aramid fiber nonwoven fabric sheet during an operation of the fixing device having incorporated therein the sliding member produced in the present embodiment.

Furthermore, preferably, depending on the equivalent of the functional group of the siloxane to be heated and fired and the amount thereof to be added, the heating temperature and the heating time are adjusted as appropriate. When the heating temperature is too low or the heating time is too short, the aramid fiber nonwoven fabric sheet's siloxane modification is insufficient and the produced sliding member's durability may be decreased. On the other hand, when the heating temperature is too high or the heating time is too long, the aramid fiber nonwoven fabric sheet and the siloxane may be thermally oxidized and decomposed. Note that a standard heating temperature is in a range of 180-220° C., and a standard heating time is about 1-2 hours.

In the method for producing the sliding member in the present embodiment, instead of using an aramid fiber nonwoven fabric sheet as the holding member, a nonwoven fabric which is composed of polyimide fiber, a heat-resistant fiber-containing resin, or other heat-resistant fibers etc. can be used. These cases also allow a similar method to be used to allow the nonwoven fabric, the resin or the fiber to have surface siloxane-modified.

Herein, whether the aramid fiber nonwoven fabric sheet has a surface siloxane-modified and whether the siloxane has been fixed on the aramid fiber nonwoven fabric sheet as desired can be confirmed by the following method: More specifically, an analysis device such as FT-IR, HPLC-MS, GC-MS, NMR etc. can be used to determine the modified aramid fiber nonwoven fabric sheet's chemical structure and qualify and quantify it.

<Sliding Member for Fixing Device>

A sliding member for a fixing device of the present embodiment is the above sliding member used for the fixing device. This fixing device includes a roller and an endless belt rotating together in contact with each other, and a pressing member which is disposed at an inner circumferential side of this endless belt and presses an inner circumferential surface of the endless belt toward the roller and thus cooperates with the roller to sandwich the endless belt. The above sliding member is disposed between the endless belt and the pressing member in the form for example of a sheet. Note that, as has been discussed above, the sliding member is not limited in shape to a sheet, and it may be a rectangular parallelepiped, or a cylinder having a horizontally circular or elliptical cross section. Furthermore, the sliding member for the fixing device may be disposed as a portion of the pressing member.

<Fixing Device>

A fixing device 10 according to the present embodiment, as shown in FIG. 1, includes a roller 11 and an endless belt 12 rotating together in contact with each other in directions indicated by arrows A and B, respectively, a pressing member 13 which is disposed at an inner circumferential side of endless belt 12 and presses an inner circumferential surface of endless belt 12 toward roller 11 and thus cooperates with roller 11 to sandwich endless belt 12, and a sliding member 14 disposed between endless belt 12 and pressing member 13. Roller 11 can be any known roller used for the fixing device 10. Furthermore, the fixing device 10 according to the present embodiment may have the sliding member 14 disposed as a portion of the pressing member 13, as will be described later.

<Endless Belt>

Endless belt 12 has an inner circumferential surface including a base material having at least one of a free amino group and a free carbonyl group. Specifically, endless belt 12 can employ as its inner circumferential surface's base material any one of polyimide resin, polyamideimide resin, and aromatic polyetheretherketone (PEEK) resin. Preferably, thermosetting polyimide resin is used, in particular, in view of heat resistance and strength. Thermosetting polyimide resin at least has a free amino group and a free carbonyl group.

Furthermore, more preferably, the base material of the inner circumferential surface of endless belt 12 includes siloxane which has a reactive substituent. Causing the base material of the inner circumferential surface of endless belt 12 to contain the siloxane which has the reactive substituent can be achieved in a method similar to the above described method for producing the sliding member 14. More specifically, initially, the siloxane which has the reactive substituent is immersed in or applied to the base material of the inner circumferential surface of endless belt 12 to impregnate the base material with the siloxane. Subsequently, endless belt 12 having the inner circumferential surface's base material impregnated with siloxane may be heated and thus fired for about 1-2 hours in a temperature range of 180-220° C. using an oven capable of controlling moisture by dry air etc. Furthermore, it is preferable that endless belt 12 be also siloxane-modified during an operation of the fixing device 10 having the sliding member 14 produced in the present embodiment, as the free amino group or free carbonyl group included in the base material of the inner circumferential surface of endless belt 12 and unreacted siloxane contained in the sliding member 14 react with each other. Accordingly, preferably, the sliding member 14 is produced such that a sliding member 14 formed of an aramid fiber nonwoven fabric sheet or the like is impregnated with the reactive siloxane in an excessive amount.

Furthermore, when thermosetting polyimide resin is used as a base material of the inner circumferential surface of endless belt 12, siloxane which has a reactive substituent as described above is added to polyimide varnish at a proportion of 0.5-5 parts by mass relative to 100 parts by mass of the polyimide's solid content. And the siloxane-containing polyimide varnish is applied to the inner circumferential surface of endless belt 12, and endless belt 12 is heated to set the thermosetting polyimide resin. Endless belt 12 having an inner circumferential surface with a base material of the siloxane modified thermosetting polyimide resin can be obtained. This is because the free amino group and free carbonyl group in the thermosetting polyimide resin chemically bond to the reactive substituent of the siloxane by heating.

Note that attention should be paid when in place of thermosetting polyimide resin a thermoplastic resin other than described above is applied as a base material of the inner circumferential surface of endless belt 12, and an attempt is made to contain therein siloxane having the reactive substituent, there is a possibility that an effect by containing siloxane may not be obtained. In that case, the temperature applied to form the base material of the inner circumferential surface of endless belt 12 exceeds 250° C., and there is a possibility that the siloxane which has the reactive substituent may be thermally oxidized and decomposed. Preferably, endless belt 12 has an outer circumferential surface with a fluorine coated layer or a fluororesin containing layer formed thereon.

<Pressing Member>

Figure 2:
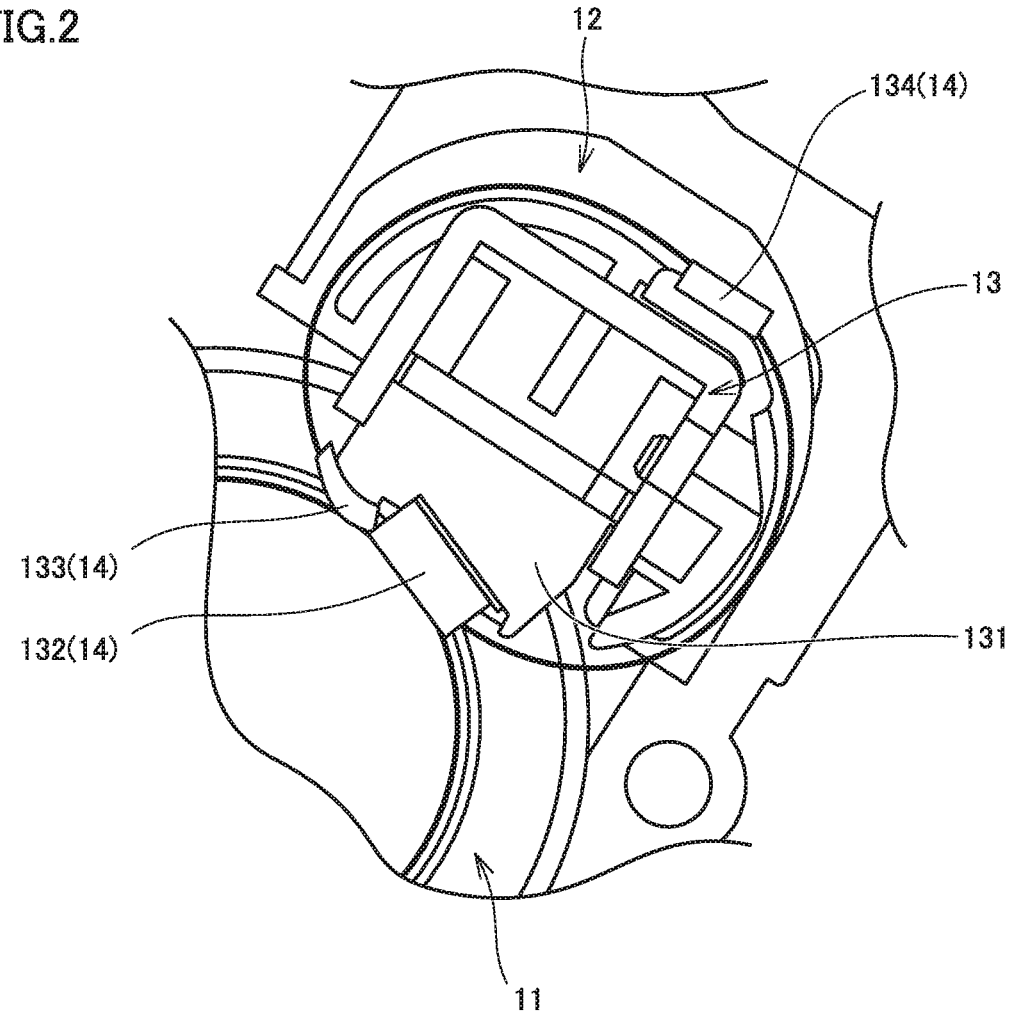
FIG. 2 is an enlarged schematic diagram showing a schematic configuration in a vicinity of an endless belt in a fixing device of the present embodiment.

Pressing member 13 has a support portion 131 serving as the pressing member's body, and a nip forming portion 132 and a high-pressure sliding portion 133, as shown in FIG. 2. Furthermore, pressing member 13 has a second sliding portion 134 in a position opposite to nip forming portion 132 with support portion 131 interposed. Nip forming portion 132 is disposed at an inner circumferential side of endless belt 12 adjacent to roller 11, and for example serves as sliding member 14 of the present embodiment to press endless belt 12 and cooperate with roller 11 to have an effect to pressure-feed a recording sheet S which is a sheet of paper.

Furthermore, although not shown, the nip forming portion 132 can be configured to be disposed at an inner circumferential side of the endless belt 12 adjacent to the roller 11, and press the endless belt 12 via the sliding member 14 and cooperate with the roller 11 to pressure-feed a recording sheet S which is a sheet of paper. In that case, it is preferable that the sliding member 14 be disposed in the form of a sheet between the nip forming portion 132 and the endless belt 12.

Nip forming portion 132 is required to be of a material which has heat resistance for fixing transferred toner on recording sheet S, and large strength and low thermal conductivity, and for example, silicone elastomer and heat-resistant nonwoven fabric are suitably used. Furthermore, when sliding member 14 of the present embodiment is applied as nip forming portion 132 which is a portion of pressing member 13, as described above, the two functions of formation of a nip and high slidability can be had by a single component, which is advantageous in terms of cost. At the time, the shape of sliding member 14 may be a shape required as nip forming portion 132.

High-pressure sliding portion 133 is disposed on a side to which recording sheet S is pressure-fed from nip forming portion 132, and for example high-pressure sliding portion 133 serves as sliding member 14 of the present embodiment to apply pressure to have an effect to separate recording sheet S from roller 11. Furthermore, although not shown, the high-pressure sliding portion 133 can be configured such that it is disposed on a side to which a recording sheet S is pressure-fed from the nip forming portion 132, and it applies pressure via the sliding member 14 to separate the recording sheet S from the roller 11. In that case, it is preferable that the sliding member 14 be disposed in the form of a sheet between the high-pressure sliding portion 133 and the endless belt 12.

High-pressure sliding portion 133 is required to be of a material having high slidability, heat resistance, large strength, low thermal conductivity, and wear resistance. Furthermore, when sliding member 14 of the present embodiment is applied as high-pressure sliding portion 133 which is a portion of pressing member 13, as described above, required performance can be exactly satisfied, which is preferable. At the time, the shape of sliding member 14 may be a shape required as high-pressure sliding portion 133.

Preferably, high-pressure sliding portion 133 also includes a curved surface having a curvature κ of 0.15 or more and 1 or less. Specifically, the above curvature κ is given to each of surfaces of high-pressure sliding portion 133 which contact roller 11 and endless belt 12, respectively. Such a curved surface allows high-pressure sliding portion 133 to apply higher contact pressure to recording sheet S than nip forming portion 132 does to thus separate recording sheet S from roller 11 and thus suppress paper jam. Furthermore, such a curved surface can reduce the contact area of the inner circumferential surface of endless belt 12 and high-pressure sliding portion 133, and hence reduce sliding resistance and hence sliding torque. Note that curvature κ of a preferable curved surface which high-pressure sliding portion 133 includes is 0.165 or more and 0.7 or less.

Furthermore, pressing member 13 is provided with second sliding portion 134 in a position opposite to nip forming portion 132 with support portion 131 interposed, as has been previously described. Second sliding portion 134 is in contact with endless belt 12 and has an effect to press it. Second sliding portion 134 is required to be of a material having heat resistance to endure endless belt 12 heated, low thermal conductivity and high slidability. Sliding member 14 of the present embodiment can also be applied to second sliding portion 134, and in that case, required performance can be exactly satisfied, which is preferable. At the time, the shape of sliding member 14 may be a shape required as second sliding portion 134. Note that in the present embodiment, the pressing member is not limited in configuration to applying the above sliding member 14 to the second sliding portion 134, and it may be configured such that the sliding member 14 is in the form of a sheet and this sliding member 14 is disposed between the second sliding portion 134 and the endless belt 12.

When fixing device 10 is in the belt nip fixing system, pressing member 13 is required to have low thermal conductivity. Accordingly, support portion 131 is required to be of a material which has low thermal conductivity as well as heat resistance, large strength, and high dimensional stability. Specifically, suitably used as support portion 131 is thermoplastic resin composed of heat resistant resin, such as liquid crystal polymer (LCP), polyimide, polyphenylene sulfide (PPS), with glass fiber, carbon fiber, etc. blended therewith. Note, however, that as the sliding member 14 of the present embodiment can be configured from a nonwoven fabric fiber sheet such as an aramid fiber nonwoven fabric sheet and these have low thermal conductivity, a metal such as a sheet metal can also be used as the pressing member 13 and the support portion 131.

<Heater>

Fixing device 10 according to the present embodiment includes a heater 15 which heats at least one of roller 11 and endless belt 12. As shown in FIG. 1, in the present embodiment, heater 15 is disposed inside roller 11. As heater 15, a halogen heater can be used in view of cost and durability. Note that heater 15 can be installed at a location which can be selected as appropriate depending on a variety of required qualities such as reduction of cost, warm up time, etc, rapid response, power consumption, etc. Heater 15 may be disposed at either one of roller 11 or endless belt 12 or may be disposed at both of them.

<Image Formation Apparatus>

Hereinafter, an image formation apparatus 100 of the present embodiment will be described based on FIG. 3.

Figure 3:
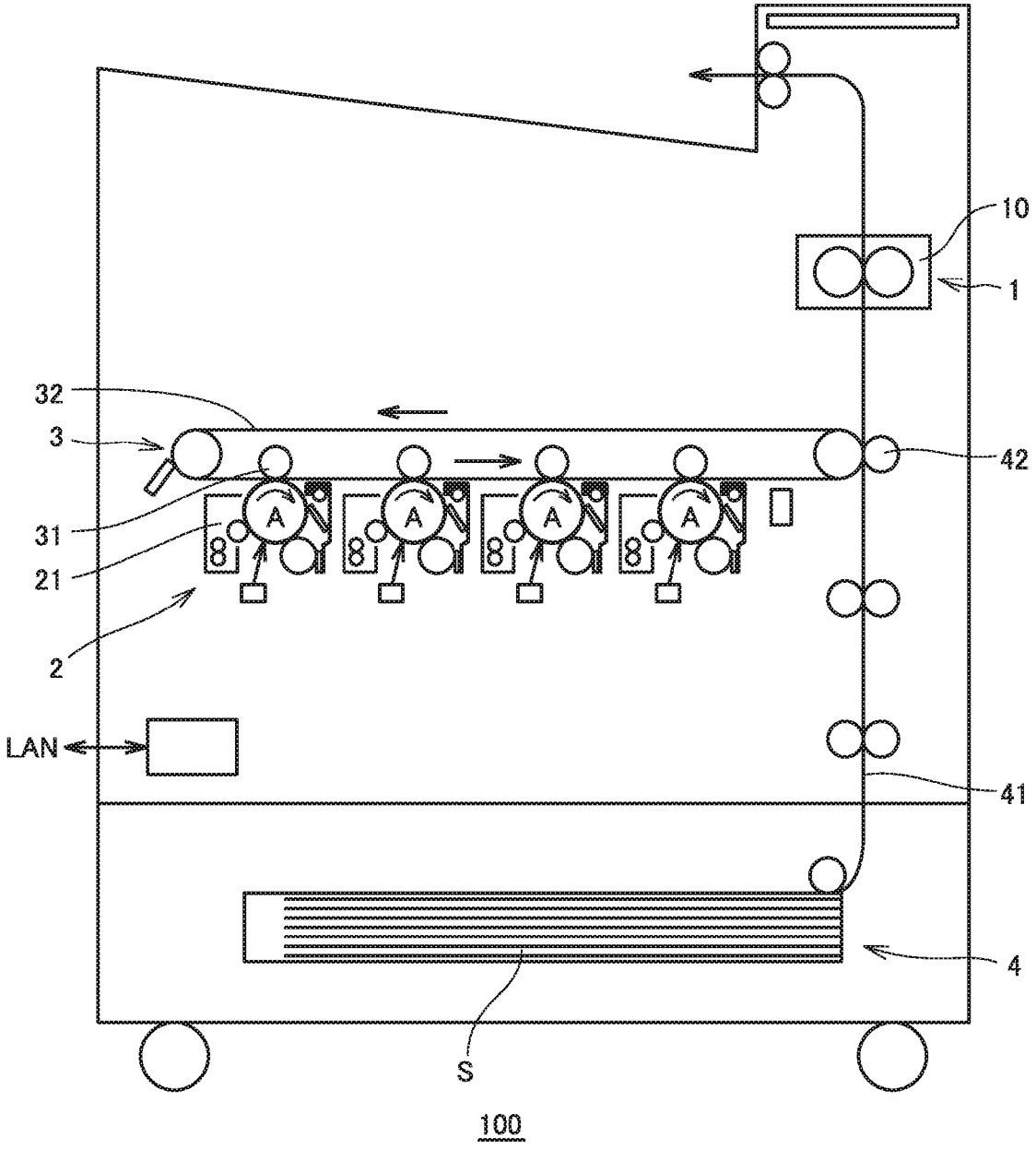
FIG. 3 is a schematic diagram showing a schematic configuration of an image formation apparatus of the present embodiment.

As shown in FIG. 3, image formation apparatus 100 includes fixing device 10 comprising the sliding member 14 of the present embodiment in a fixing unit 1 described later. Image formation apparatus 100 is an apparatus which forms an image on recording sheet S by a known electrophotography system, and includes, as well as fixing unit 1, an image processing unit 2, a transfer unit 3, a sheet feeding unit 4, and a control unit (not shown). Image formation apparatus 100 receives a printing job from an external terminal device (not shown) via a network (e.g., a LAN), and selectively performs color or monochrome printing based on the printing job.

Image processing unit 2 has an image forming unit 21 corresponding to a developing color of each of yellow (Y), magenta (M), cyan (C), and black (K), and forms a toner image composed of each color based on the above printing job. Transfer unit 3 has a primary transfer roller 31 and an endless belt-shaped intermediate transfer body 32, and transfers the toner image that is formed by image forming unit 21 and composed of each color to intermediate transfer body 32 via primary transfer roller 31 through an electrostatic effect.

Sheet feeding unit 4 is timed, in response to image forming unit 21 forming a toner image, to feed recording sheets S, one by one, from a sheet feeding cassette to a transport path 41 to transport the sheet toward a secondary transfer roller 42. When recording sheet S transported passes between secondary transfer roller 42 and intermediate transfer body 32, the toner image formed on intermediate transfer body 32 is collectively, secondarily transferred onto recording sheet S through an electrostatic effect of secondary transfer roller 42.

Recording sheet S after the toner image is secondarily transferred thereon is transported to fixing unit 1. And in fixing device 10 with which fixing unit 1 is equipped, the toner is fused and thus fixed on a surface of recording sheet S. Subsequently, the recording sheet S is discharged by a sheet discharging roller onto a sheet discharging tray. Thus, an image corresponding to the toner image is formed on recording sheet S.

Note that while the above description corresponds to an operation in performing a color mode, when printing in black (i.e., a monochrome mode) is performed, the image forming unit for black color is alone driven and through each prescribed step an image in black is formed (or printed) on recording sheet S.

Furthermore, the control unit controls each component based on data of a printing job received from the external terminal device via the network to perform a smooth printing operation. Note that image formation apparatus 100 is provided with a console panel at a position on a front and upper side of the body of the apparatus which allows the user to easily operate the console panel. The console panel includes a button to receive a variety of instructions from the user, a liquid crystal display unit in the form of a touch panel, etc., and transmits a received instruction to the control unit.

As such an image formation apparatus, an image formation apparatus of an electrophotography system, such as a copier, a printer, a digital printer, and a simple printer, etc. can be mentioned for example. Although these image formation apparatuses may be of any of a dry system and a wet system, an image formation apparatus in the wet system is particularly effective. The image formation apparatus includes a fixing device which has the sliding member according to the present embodiment, and can thus reduce image noise for a long term and thus form an image of high quality.

EXAMPLES

Some sliding members according to the present embodiment underwent a performance assessment and a result thereof will be described hereinafter. To assess the sliding members in performance, a color printer (trade name: "magicolor (registered trademark) 4750DN" produced by Konica Minolta Inc.) including a configuration similar to that of the fixing device described above was used. Specifically, the sliding members of examples 1-6 and comparative examples 1-2 shown in the following tables 1 and 2 were each disposed between the pressing member and the endless belt in the fixing device of the above color printer. In particular, in examples 4-6, as a configuration of the fixing device of the above color printer, an endless belt having an inner circumferential surface with a base material siloxane-modified was used.

In the performance assessment of the sliding members, the roller was set to a temperature of 200° C. and the fixing device was alone continuously driven by an external motor at a speed of 250 mm/sec for 500 hours. More specifically, without performing a fixing operation for a recording sheet, the fixing device was continuously driven for 500 hours to continuously slide the sliding member for 500 hours between the endless belt and the pressing member. The performance assessment was done such that a torque (N·m) of the external motor immediately after driving the device was started (i.e., in an initial stage) and a torque (N·m) of the external motor whenever a period of time of 100 hours elapsed while the device was continuously driven were measured, and their variation was monitored.

Note that the external motor's torque was measured under the following conditions:

Temperature: 200° C.

Driving rate: 250 mm/s

Set load: 180 N.

Example 1

(Producing a Sliding Member)

An example 1 provided a sliding member produced as follows: as the holding member, an aramid fiber nonwoven fabric sheet (trade name: "Conex (registered trademark)" produced by TEIJIN LIMITED) having a weight of 600 g/m$^2$ was used, and this nonwoven fabric sheet was impregnated with a reactive siloxane which is amino modified siloxane having a free amino group (trade name: "X-22-161B" produced by Shin-Etsu Chemical Co., Ltd.). Specifically, an aramid fiber nonwoven fabric sheet of 3 mm in thickness and 6 mm in width was initially disposed at the nip forming portion of the pressing member, an aramid fiber nonwoven fabric sheet of 1 mm in thickness and 6 mm in width was disposed at the high-pressure sliding portion and the above aramid fiber nonwoven fabric sheet of 2 mm in thickness and 6 mm in width was disposed at the second sliding portion, and they were each fixed with heat-resistant double-faced tape. Subsequently, the aramid fiber nonwoven fabric sheets of the nip forming portion, high-pressure sliding portion, and second sliding portion were impregnated with 3 g, 1 g, and 2 g, respectively, of the amino modified siloxane and they were heated and thus subjected to siloxane modification. In this siloxane modification, while the pressing member was exposed to dry air having a dew point of −20° C. or lower, it was heated and thus fired at 200° C. for 1 hour.

Example 2

(Producing a Sliding Member)

In an example 2, except that the reactive siloxane was changed to epoxy modified siloxane having a free epoxy group (Trade name: "X-22-163B" produced by Shin-Etsu Chemical Co., Ltd.), a sliding member was produced similarly as done in example 1.

Example 3

(Producing a Sliding Member)

In an example 3, except that the reactive siloxane was changed to methacryl modified siloxane having a free carbonyl group (Trade name: "X-22-164B" produced by Shin-Etsu Chemical Co., Ltd.), a sliding member was produced similarly as done in example 1.

Example 4

(Producing a Sliding Member)

The same sliding member as example 1 was produced.

(Siloxane Modification of Inner Circumferential Surface of Endless Belt)

In an example 4, siloxane modification was also done to the base material of the inner circumferential surface of the endless belt. Specifically, one part by weight of amino modified siloxane having a free amino group (trade name: "KF393" produced by Shin-Etsu Chemical Co., Ltd.) was added to 100 parts by weight of polyimide varnish (polyimide's solid content: 20 wt %, solvent: N-methyl-2-pyrrolidone) and agitated to obtain a reactive siloxane-containing polyimide varnish mixture. Subsequently, as the endless belt, a polyimide resin belt having an outer circumferential surface covered with a fluorine tube (with the fluoride tube having a thickness of 20 μm and the polyimide resin layer having a thickness of 100 μm) was prepared, and on its internal circumferential surface, the above mixture was applied to have a thickness of 100 μm. Subsequently, while the polyimide resin belt was exposed to dry air having a dew point of −20° C. or lower, it was heated and thus fired at 200° C. for 1 hour to produce an endless belt having an inner circumferential surface with an approximately 20 μm-thick siloxane modified polyimide layer.

Example 5

(Producing a Sliding Member)

The same sliding member as example 2 was produced.

(Siloxane Modification of Inner Circumferential Surface of Endless Belt)

In an example 5 also, siloxane modification was done to the base material of the inner circumferential surface of the endless belt, and except that the reactive siloxane was changed to epoxy modified siloxane having a free epoxy group (Trade name: "KF-22-343" produced by Shin-Etsu Chemical Co., Ltd.), an endless belt was produced similarly as done in example 4.

Example 6

(Producing a Sliding Member)

The same sliding member as example 3 was produced.

(Siloxane Modification of Inner Circumferential Surface of Endless Belt)

In an example 6 also, siloxane modification was done to the base material of the inner circumferential surface of the endless belt, and except that the reactive siloxane was changed to methacryl modified siloxane having a free carbonyl group (Trade name: "X-22-164" produced by Shin-Etsu Chemical Co., Ltd.), an endless belt was produced similarly as done in example 4.

Comparative Example 1

(Producing a Sliding Member)

As a sliding member of comparative example 1 was a sliding member with which a fixing device "magicolor (registered trademark) 4750DN" was equipped as a standard was used as it was. In that case, a PTFE-based, heat-resistant sheet is used as the holding member. Furthermore, this holding member is impregnated with a lubricant of a non-reactive silicone oil (trade name: "KF-96-300cs" produced by Shin-Etsu Chemical Co., Ltd.).

Comparative Example 2

(Producing a Sliding Member)

A sliding member of comparative example 2 employed a non-reactive silicone oil (trade name: "KF-96-300cs" produced by Shin-Etsu Chemical Co., Ltd.) instead of the reactive siloxane used in example 1. Specifically, an aramid fiber nonwoven fabric sheet of 3 mm in thickness and 6 mm in width was disposed at the nip forming portion of the pressing member, an aramid fiber nonwoven fabric sheet of 1 mm in thickness and 6 mm in width was disposed at the high-pressure sliding portion and the above aramid fiber nonwoven fabric sheet of 2 mm in thickness and 6 mm in width was disposed at the second sliding portion, and they were each fixed with heat-resistant double-faced tape. Subsequently, to the aramid fiber nonwoven fabric sheets of the nip forming portion, high-pressure sliding portion, and second sliding portion, 1.5 g, 0.5 g and 1 g, respectively, of the non-reactive silicone oil was added to produce a sliding member formed of a silicone oil-impregnated, aramid fiber nonwoven fabric.

A result of the performance assessment is shown in table 1 and table 2. Furthermore, in FIG. 4, a graph is presented to show how torque generated varies as the driving time elapses in each of the examples and comparative examples.

TABLE 2

| | | lubricant: | assessment result: torque (N · m) | | |
|---|---|---|---|---|---|
| comparative example | holding member | trade name | initial | after 400 hrs | detects |
| 1 | PTFE-based | KF-96-300cs | 0.15 | 0.7 | Noise generated after 350 hours. Belt damaged after 410 hours. |
| 2 | aramid fiber | KF-96-300cs | 0.20 | 0.55 | Noise generated after 300 hours. |

<Assessment Result>

It can be seen from tables 1 and 2 that when the siloxane modified aramid fiber nonwoven fabric sheet was used as the sliding member, as in examples 1-6, torque varied in a small range between a time immediately after the driving started (or an initial stage) and a time after the driving of 400 hours, and it can be used stably for a long period of time. In particular, when siloxane modification was also done to the base material of the inner circumferential surface of the endless belt, as in examples 4-6, torque varied in a smaller range between the time immediately after the driving started (or the initial stage) and the time after the driving of 400 hours, and improvement in performance in long-term use has been confirmed.

On the other hand, comparative example 1 presented torque varying in a large range between the time immediately after the driving started (or the initial stage) and the time after the driving of 400 hours, and together with noise, the belt was damaged. Comparative example 2 presented torque varying in a large range between the time immediately after the driving started (or the initial stage) and the time after the driving of 400 hours, and noise was generated. It is believed that the noise was generated because the lubricant leaked or the like and was thus insufficient. It is believed that the belt's damage is also a defect caused as the lubricant was significantly insufficient.

Figure 4:
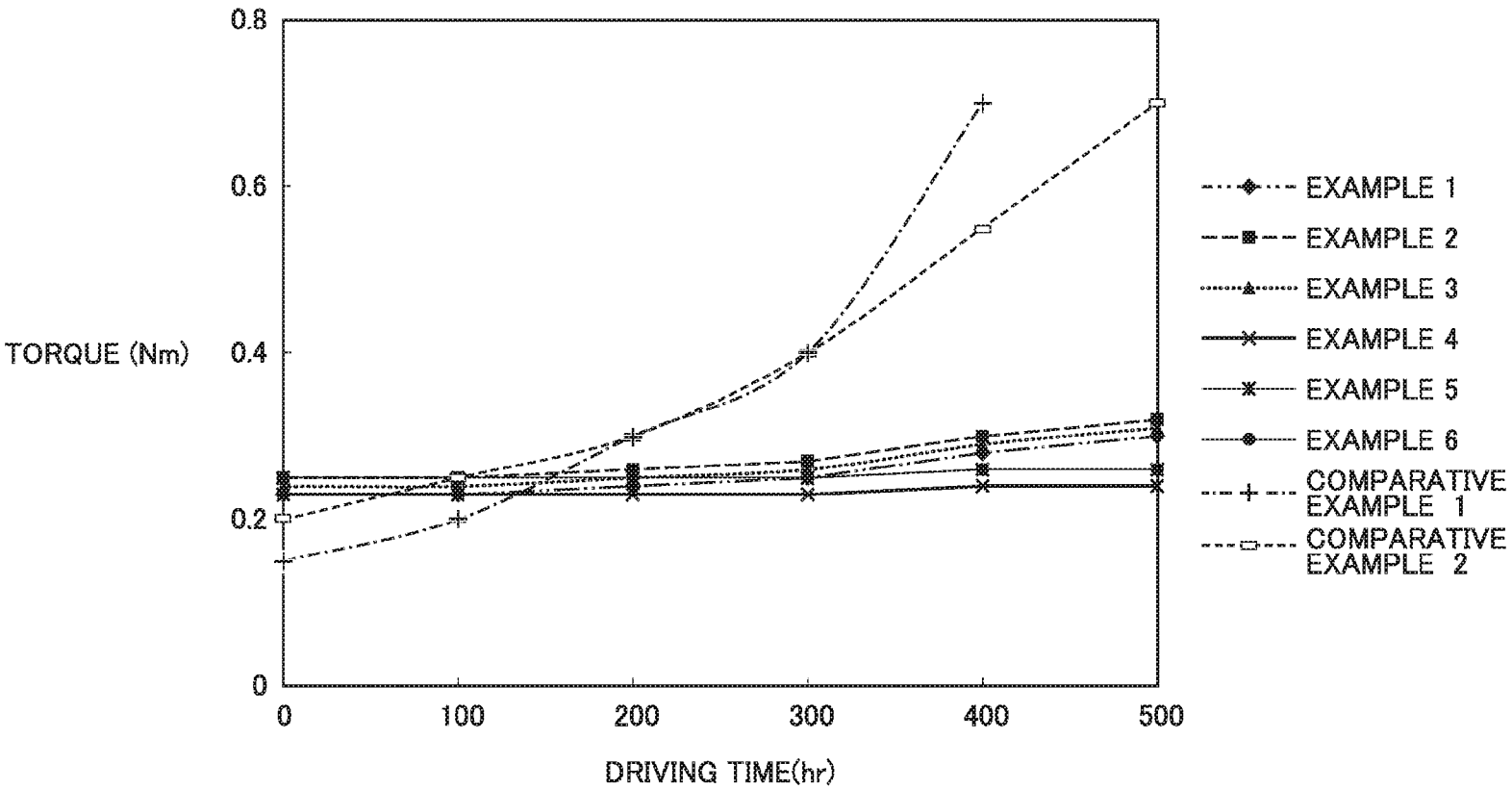
FIG. 4 is a graph which shows a relationship between a period of time of driving the fixing device in the present embodiment and torque generated.

Furthermore, it is understood from FIG. 4 that examples 1-6 can maintain for a long period of time the slidability of the same level as that immediately after the driving started (i.e., of the initial stage). In contrast, comparative examples 1 and 2 immediately after the driving started (i.e., in the initial stage) presented torque lower than examples 1-3 and hence high slidability, however, as the driving time elapses, the slidability was lost, and after a period of time of 100-150 hours elapsed, a slidability lower than examples 1-6 was presented. Note that in comparative example 1, the belt was damaged and accordingly, continuously driving the device

TABLE 1

| | | reactive siloxane | | | siloxane modification of inner circumferential surface of belt | | assessment result: torque (N · m) | | |
|---|---|---|---|---|---|---|---|---|---|
| example | holding member | trade name | viscosity (25° C.) [mm²/s] | reactive substituent | reactive siloxane: trade name | reactive substituent | initial | after 400 hrs | defects |
| 1 | aramid fiber | X-22-161B | 55 | amino | — | — | 0.23 | 0.28 | Defects such as noise, damage to belt, etc. have not been confirmed. |
| 2 | aramid fiber | X-22-163B | 60 | epoxy | — | — | 0.25 | 0.30 | |
| 3 | aramid fiber | X-22-164B | 55 | carbonyl | — | — | 0.24 | 0.29 | |
| 4 | aramid fiber | X-22-161B | 55 | amino | KF-393 | amino | 0.23 | 0.24 | |
| 5 | aranrid fiber | X-22-163B | 60 | epoxy | KF-22-343 | epoxy | 0.25 | 0.26 | |
| 6 | aramid fiber | X-22-164B | 55 | carbonyl | X-22-164 | carbonyl | 0.25 | 0.26 | |

was stopped before a period of time of 500 hours elapsed. It is thus understood that examples 1-6 that use a siloxane modified aramid fiber nonwoven fabric sheet as a sliding member can provide a sliding member which can prevent reduction in durability performance resulting form degradation of a lubricant and can thus be used for a long period of time.

Note that the image formation apparatus to which the fixing device including the sliding member according to the present embodiment is applied is not limited to a tandem-type color digital printer and may be a printer which forms a monochrome image. Furthermore, the image formation apparatus is applicable not only to a printer but also to a copier, an MFP (Multiple Function Peripheral), a fax, etc. (in any case, it may be any for a color image or a monochrome image).

Thus the present invention can provide a sliding member which can prevent reduction in durability performance resulting form degradation of a lubricant and can thus be used for a long period of time.

While the present invention has been described in embodiments, it should be understood that the embodiments disclosed herein are illustrative and non-restrictive in any respect. The scope of the present invention is defined by the terms of the claims, and is intended to include any modifications within the meaning and scope equivalent to the terms of the claims.

What is claimed is:

1. A sliding member comprising:

siloxane having a reactive substituent; and a holding member having a group which can react with the substituent and bonds to the substituent to hold the siloxane.

2. The sliding member according to claim 1, wherein the holding member includes a heat-resistant fiber which has either one or both of a free amino group and a free carbonyl group.

3. The sliding member according to claim 2, wherein the heat-resistant fiber is aramid fiber.

4. The sliding member according to claim 1, wherein the holding member is a nonwoven fabric composed of aramid fiber.

5. The sliding member according to claim 1, wherein the reactive substituent is one or more types selected from a free amino group, a free epoxy group, and a free carbonyl group.

6. A sliding member recited in claim 1 and used for a fixing device, the fixing device including a roller and an endless belt rotating together in contact with each other, and a pressing member disposed at an inner circumferential side of the endless belt, and pressing an inner circumferential surface of the endless belt toward the roller and thus cooperating with the roller to sandwich the endless belt, the sliding member being disposed between the endless belt and the pressing member or as a portion of the pressing member.

7. A fixing device comprising:

a roller and an endless belt rotating together in contact with each other;

a pressing member disposed at an inner circumferential side of the endless belt, and pressing an inner circumferential surface of the endless belt toward the roller and thus cooperating with the roller to sandwich the endless belt; and a sliding member recited in claim 1 and disposed between the endless belt and the pressing member or as a portion of the pressing member, a base material included in the inner circumferential surface of the endless belt having at least one of a free amino group and a free carbonyl group.

8. The fixing device according to claim 7, wherein the base material is polyimide resin.

9. The fixing device according to claim 7, wherein the base material includes siloxane having the reactive substituent.

10. The fixing device according to claim 7, wherein:

the pressing member has a nip forming portion and a high-pressure sliding portion;

the nip forming portion is disposed at an inner circumferential side of the endless belt adjacent to the roller, and, as the sliding member or via the sliding member, presses the inner circumferential surface of the endless belt and thus cooperates with the roller to pressure-feed a sheet; and the high-pressure sliding portion is disposed on a side to which the sheet is pressure-fed from the nip forming portion, and as the sliding member or via the sliding member, applies pressure to separate the sheet from the roller.

11. The fixing device according to claim 10, wherein the high-pressure sliding portion has a curved surface having a curvature $\kappa$ of 0.15 or more and 1 or less.

12. The fixing device according to claim 7, comprising a heater to heat at least one of the roller and the endless belt.

13. An image formation apparatus comprising the fixing device according to claim 7.

14. A method for producing a sliding member comprising a holding member, comprising:

impregnating the holding member with siloxane having a reactive substituent; and heating and firing the holding member that is impregnated with the siloxane to cause the holding member to hold the siloxane.

* * * * *